US006971645B2

(12) United States Patent
Coret et al.

(10) Patent No.: US 6,971,645 B2
(45) Date of Patent: Dec. 6, 2005

(54) DEVICE FOR SELECTING MAIL ITEMS

(75) Inventors: Francis Coret, Gournay sur Marne (FR); Romain Pillard, Nemours (FR)

(73) Assignee: Neopost Industrie, Bagneux (FR)

( * ) Notice: Subject to any disclaimer, the term of this patent is extended or adjusted under 35 U.S.C. 154(b) by 197 days.

(21) Appl. No.: 10/325,863

(22) Filed: Dec. 23, 2002

(65) Prior Publication Data

US 2003/0141650 A1 Jul. 31, 2003

(30) Foreign Application Priority Data

Dec. 24, 2001 (FR) ..... 01 16814

(51) Int. Cl.[7] ..... B65H 3/52
(52) U.S. Cl. ..... 271/138; 271/137; 271/35
(58) Field of Search ..... 271/2, 137, 121, 271/138, 35

(56) References Cited

U.S. PATENT DOCUMENTS

| | | | | |
|---|---|---|---|---|
| 1,046,190 | A * | 12/1912 | Huddleston | 101/241 |
| 1,588,843 | A * | 6/1926 | Labombarde | 271/35 |
| 1,948,362 | A * | 2/1934 | Staude | 271/35 |
| 2,448,303 | A * | 8/1948 | Fors | 271/138 |
| 3,111,885 | A * | 11/1963 | Perrelli | 493/419 |
| 3,126,201 | A * | 3/1964 | Rehm | 271/104 |
| 3,151,863 | A * | 10/1964 | Lohr | 271/121 |
| 3,895,791 | A * | 7/1975 | Kramell et al. | 271/35 |
| 4,083,555 | A * | 4/1978 | Irvine et al. | 271/10.13 |
| 4,568,074 | A * | 2/1986 | Murayoshi | 271/121 |
| 4,909,499 | A | 3/1990 | O'Brien et al. | |
| 4,978,114 | A | 12/1990 | Holbrook | |
| 5,004,218 | A * | 4/1991 | Sardano et al. | 271/35 |
| 5,011,124 | A * | 4/1991 | Sardano et al. | 271/35 |
| 5,083,766 | A * | 1/1992 | Osawa | 271/121 |
| 5,201,508 | A * | 4/1993 | Kuo | 271/10.03 |
| 5,431,385 | A | 7/1995 | Holbrook | |
| 6,003,857 | A * | 12/1999 | Salomon et al. | 271/122 |
| 6,135,441 | A * | 10/2000 | Belec et al. | 271/35 |
| 6,585,251 | B2 * | 7/2003 | Allen et al. | 271/121 |

FOREIGN PATENT DOCUMENTS

| | | |
|---|---|---|
| EP | 0 543 559 | 5/1993 |
| EP | 0 714 841 | 6/1996 |
| FR | 2 329 563 | 5/1977 |
| WO | WO 96/28373 | 9/1996 |

* cited by examiner

*Primary Examiner*—Patrick Mackey
(74) *Attorney, Agent, or Firm*—Sughrue Mion, PLLC

(57) ABSTRACT

The present invention relates to a selection device for separating one by one, or singulating, the items of a stack of mail items, comprising a support surface, conveying means for driving these mail items over the support surface, a mobile presser plate cooperating with the conveying means in order to drive downstream a part of the mail items issuing from the stack of mail items to be separated and corresponding to a predetermined maximum thickness of mail items, and independent, individually mobile selection means for selecting a mail item from the mail items driven by the conveying means.

11 Claims, 5 Drawing Sheets

DEVICE FOR SELECTING MAIL ITEMS

FIELD OF THE INVENTION

The present invention relates to the domain of mail handling and more particularly to a device for selecting mail items, employed in an automatic feed module in a franking machine.

BACKGROUND OF THE INVENTION

Conventionally, a franking machine must be adapted to receive different types of mail items such as more or less thick documents, letters or envelopes. To that end, it often comprises, upstream, an automatic feed module, also called feeder, allowing in particular the conveying of these mail items at different speeds and usually comprising means for receiving/stacking, selecting, conveying and possibly closing these mail items.

U.S. Pat. Nos. 4,909,499, 4,978,114 and 5,431,385 show such automatic feeders comprising a selection module adapted for the passage of mail items of different thicknesses. The selection modules of these feeders maintain the pressure on the mail items while ensuring the selection of one of them. In effect, these two functions of pressure and of selection are performed by a single system of belts inclined downstream in the direction of advance of the mail items.

Now, such systems present major drawbacks. In effect, the simultaneous management of the pressure to be exerted on the stack of mail items and of the selection of one of them does not optimalize the force of drive of these mail items through the feeder and the selection therefore strongly depends on the pressure exerted by the stack of mail items.

It is an object of the present invention to overcome the afore-mentioned drawbacks by proposing a selection device, integrated in a mail item feed module intended to be placed upstream of a franking machine, and comprising selection means which are independent of the action exerted by the stack of mail items, whether it be small or great due to the handling of a variable number of heavy envelopes, for example.

SUMMARY OF THE INVENTION

These objects are attained by a selection device for separating one by one, or singulating, the items of a stack of mail items, comprising a support surface and conveying means for driving these mail items over the support surface, characterized in that it further comprises a mobile presser plate cooperating with the conveying means in order to drive downstream a part of the mail items issuing from the stack of mail items to be separated and corresponding to a predetermined maximum thickness of mail items and independent, individually mobile selection means for selecting a mail item from the mail items driven by the conveying means.

By this specific structure which dissociates the function of feed of mail items from the function of selection proper, it is possible to ensure an automatic, particularly high-performance feed of the franking machine located downstream of the feed module. In effect, with this configuration, the weight of the stack of mail items can no longer perform a determining role on the behaviour of these items during their selection and the dimensioning of the spring of the presser plate may in that case be optimalized.

The presser plate may pivot about a hinge pin of an articulated mechanism which may itself pivot about a pivot pin so as to remain constantly parallel to said support surface whatever the number of mail items conveyed. The pivoting of said presser plate about said hinge pin is exerted against a first elastic means, of which one end is fixed to said presser plate and the other end is fixed to said articulated mechanism. The pivoting of said articulated mechanism about said pivot pin is exerted against a second elastic means, of which one end is fixed to said articulated mechanism and the other end is fixed to a fixed part of the frame of the device.

Said presser plate preferably comprises a stop for limiting its pivoting with the articulated mechanism.

The conveying means advantageously comprise parallel drive belts controlled by a common motor means and extending through said support surface.

The selection means comprise tongues interposed between the drive belts and acting against elastic means of which one end is fixed on said tongue and the other end is fixed to the fixed part or frame of the device. An additional selection tongue is advantageously arranged outside the drive belts to allow a separation of mail items of large format.

According to the invention, the selection device further comprises, downstream of said selection means, articulated return means for driving upstream all the mail items except one issuing from said selection means.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
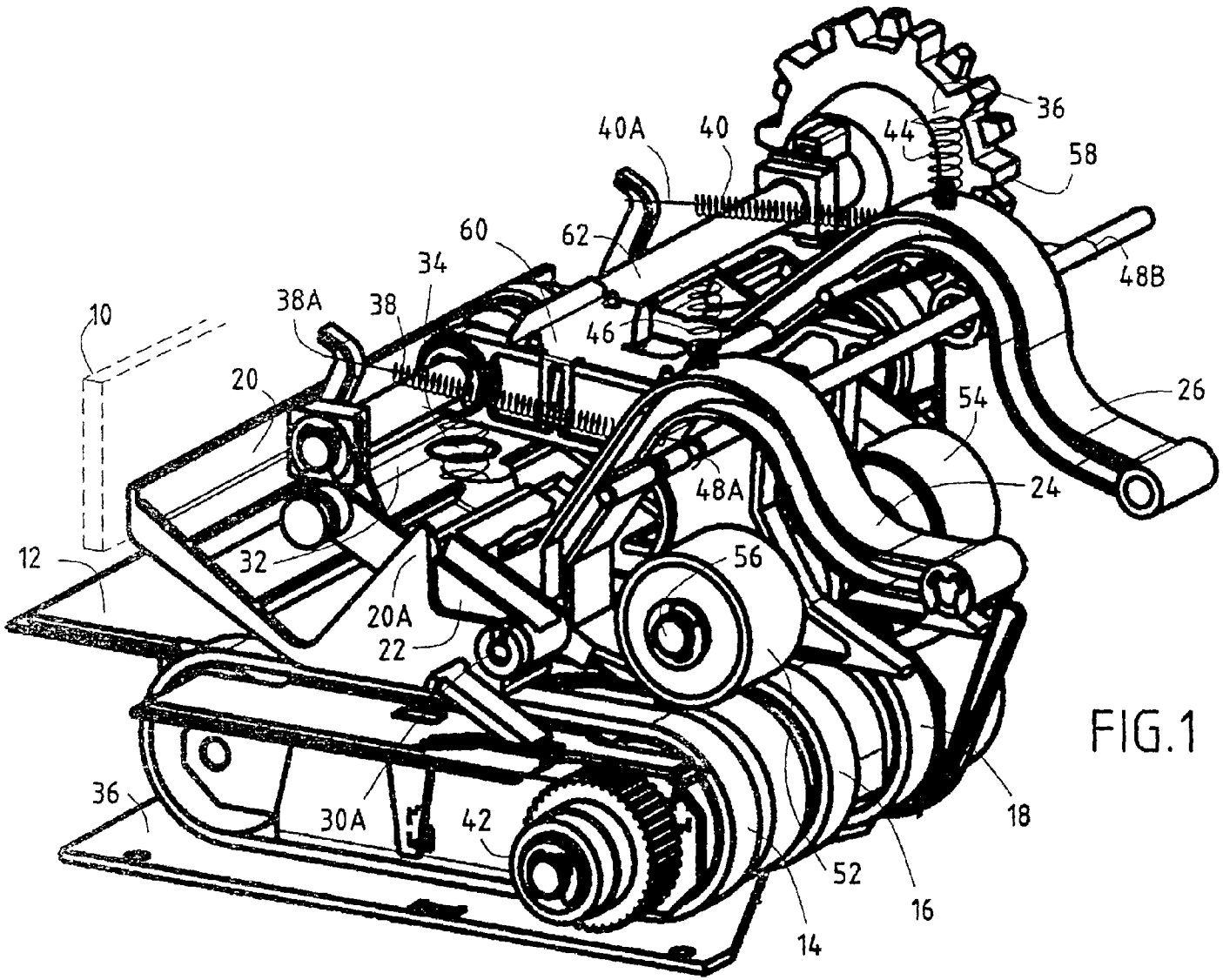
FIG. 1 is a view in perspective of a mail item selection device according to the invention.

Referring now to the drawings, an automatic mail item feed module conventionally comprises a feed zone formed essentially by a deck intended to receive a stack of mail items and comprising first conveying rollers for driving these mail items downstream (and against an aligning wall) to the level of a zone of separation comprising a selection device in which these items are extracted from the stack one by one. Second conveying rollers are generally provided at the outlet of this separation zone in order to convey the mail items thus extracted towards a module for moistening and closing these mail items (when it is present). Such an automatic feeder further comprises different known control and monitoring means necessary for its functioning (particularly for actuating the different rollers driving the mail items) which will not be described in greater detail.

FIG. 1 is a view in perspective of a selection device according to the invention. It comprises, downstream of a separation plate 10 intended to limit to a maximum value, for example 20 mm, the thickness of the stack of mail items introduced in the device above a support surface 12, a means for conveying the mail items downstream, formed by an assembly of drive belts 14, 16, 18 intended to cooperate with a presser plate 20 mounted on an articulated mechanism 22 and intended to ensure a suitable pressure on the stack of mail items before the selection of one and only one of them by individual selection means formed by independent selection tongues 24, 26 interposed between the drive belts. The independence of the selection tongues makes it possible to take into account the differences in thickness within the same mail item and to render wear uniform.

Figure 2A:
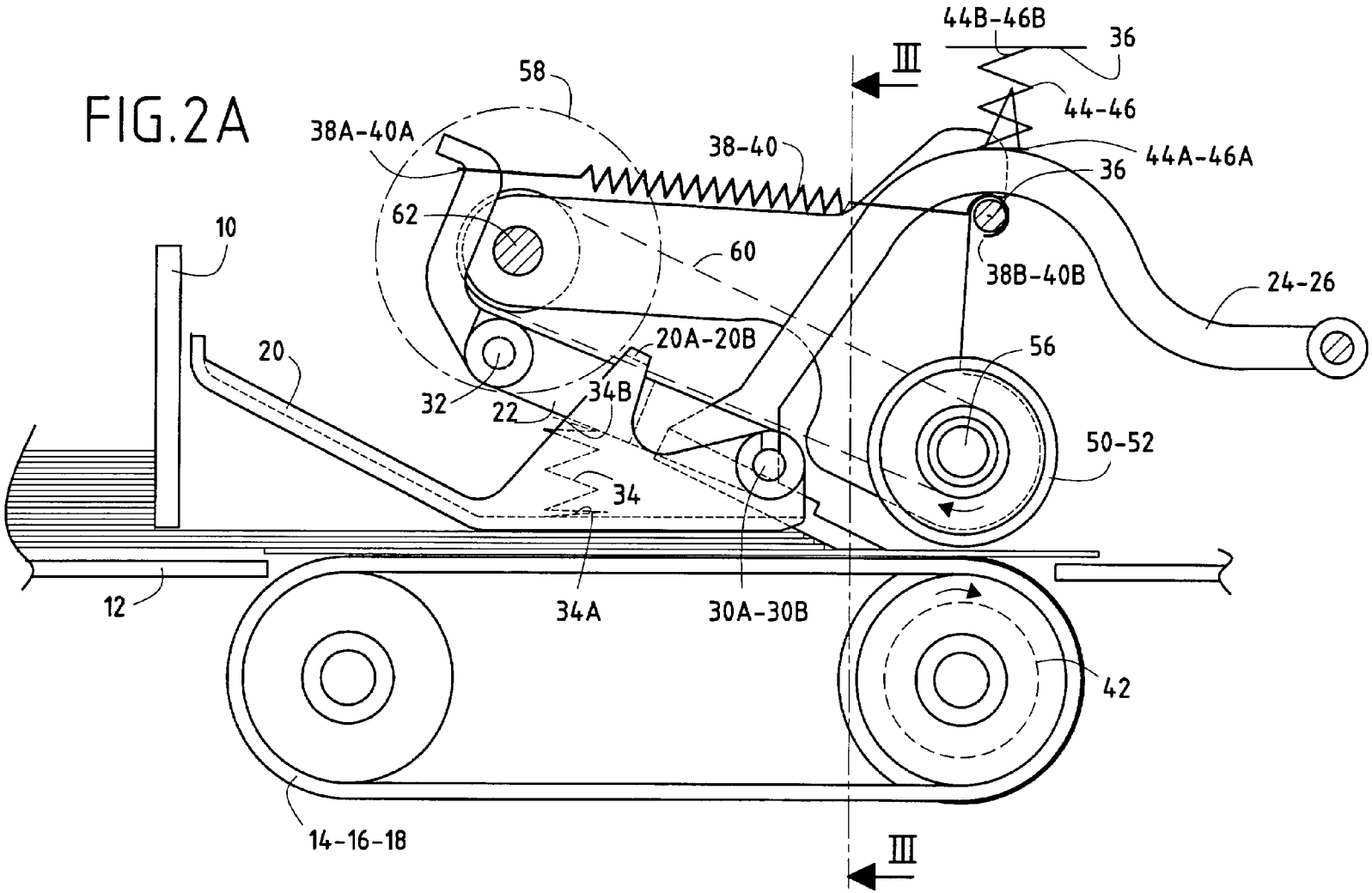
FIGS. 2A and 2B are views in longitudinal section of the selection device of FIG. 1 in two different positions of the presser plate.
Figure 2B:
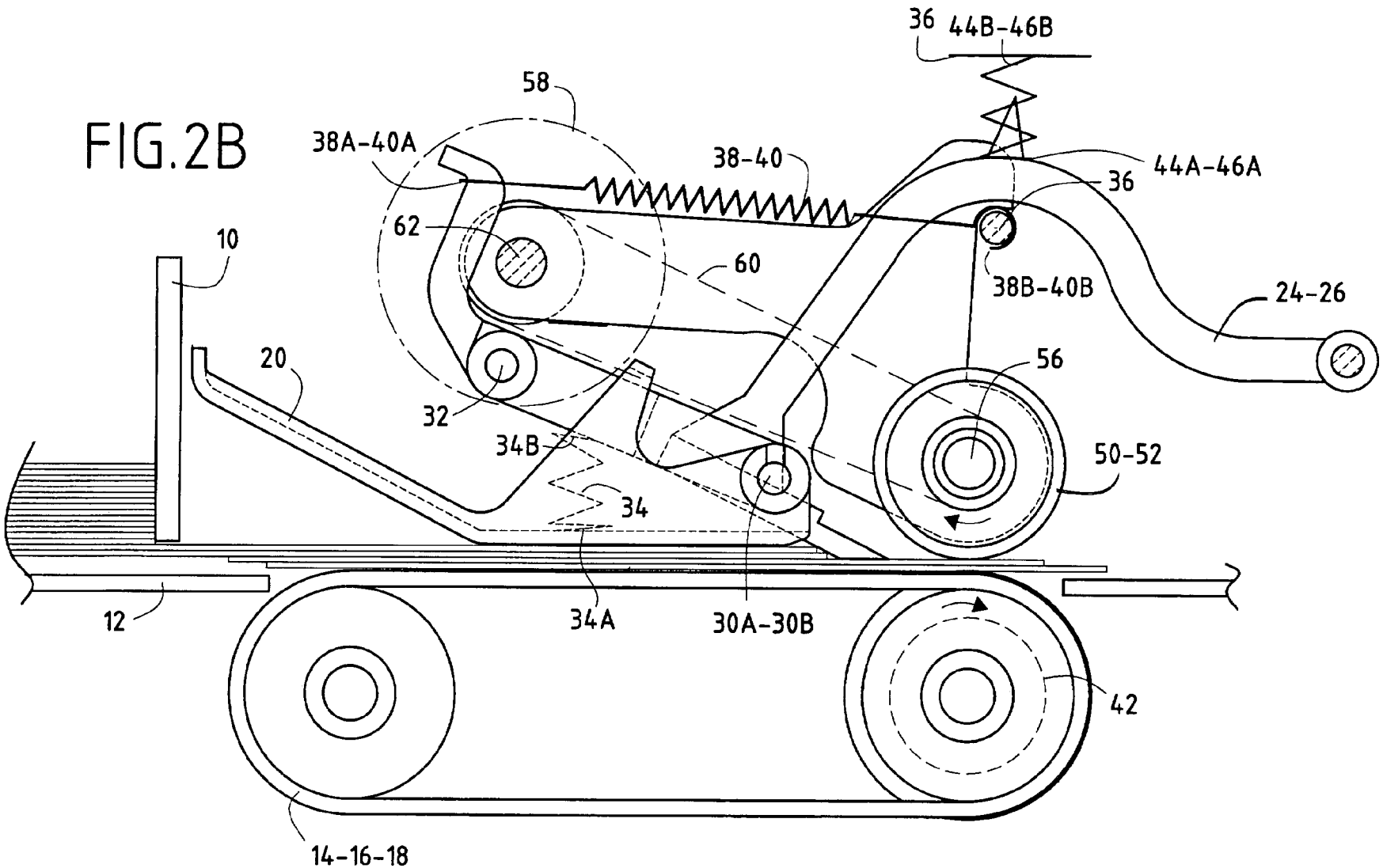
Figure 3:
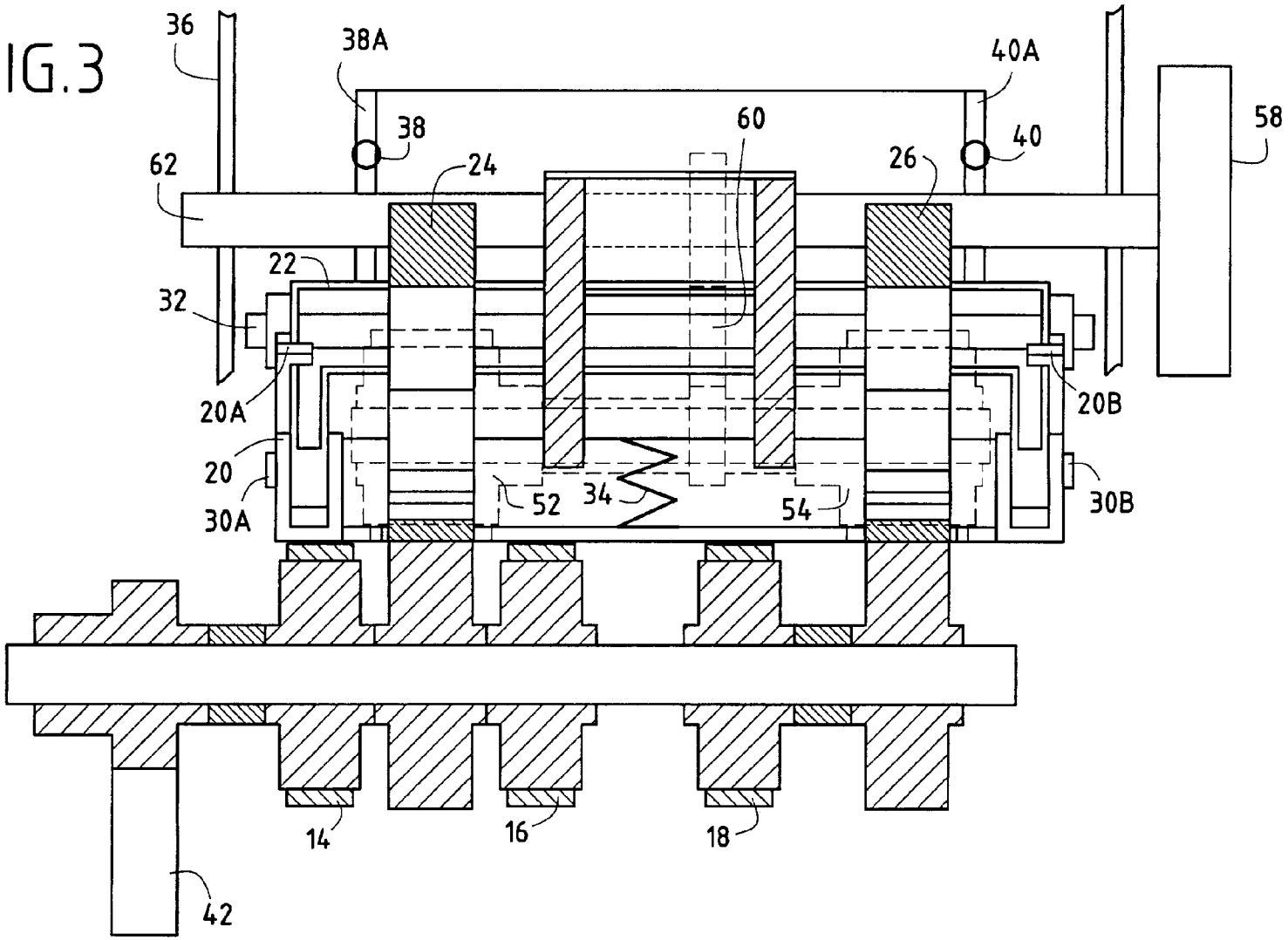
FIG. 3 is a view along plane III-III of FIG. 2.

As shown in FIGS. 2 and 3, the pressure plate may pivot about a hinge pin 30A, 30B of the articulated mechanism which may itself pivot about a pivot pin 32 so that the presser plate can remain constantly parallel to the support surface 12 whatever the number of mail items conveyed (of course, within the limit of the maximum thickness admissible). The pivoting of the presser plate about the hinge pin is exerted against a first elastic means 34 of which one end 34A is fixed to the presser plate and the other end 34B is fixed on the articulated mechanism. This first elastic means makes it possible to adapt the effort of compression of the presser plate as a function of the height of items present beneath this plate. The pivoting of the articulated mechanism about the pivot pin is exerted against a second elastic means 38, 40 of which one end 38A, 40A is fixed to the articulated mechanism (more precisely to an end of this mechanism in the shape of a duck bill) and the other end 38B, 40B is fixed to a fixed part, or frame 36, of the device. This second elastic means, whose rigidity is greater than the first elastic means (which must not prevent the opening of the plate upon passage of the mail items) makes it possible to generate a localized effort on the rear part of the presser plate. It reinforces the load applied on the mail items by the first elastic means. The hinge and pivot pins are, of course, each fixed between two longitudinal walls (not shown) of the frame on either side of the path of travel of the mail items. The presser plate further comprises a stop 20A, 20B for limiting its pivoting with the articulated mechanism in order to prevent the free opening of the presser plate and facilitate fixation of the spring 34 (in addition, the latter does not fall when an operation of maintenance is carried out on the device).

The three parallel drive belts 14, 16, 18 of the conveying means are controlled by a common motor means 42 through a gear assembly and extend through the support surface 12. The selection tongues of which two are interposed between the three drive belts, act against elastic means 44, 46 of which one end 44A, 46A is fixed on the tongue and the other end 44B, 46B is fixed to the fixed part, or frame 36, of the device. It will be noted that the selection means may also comprise a third selection tongue disposed outside the drive belts in order to facilitate separation of the mail items of large format, for example of format A4. This tongue, like the preceding ones, is mobile individually against an elastic means of which one end is fixed on the tongue and the other end is fixed to the frame.

It will be noted that the number of selection tongues and of drive belts (which might advantageously be replaced by conveyor rollers) may be variable. It depends in particular on the format of the mail items handled by the feeder. For example, for a feeder handling only envelopes of standard European format, it may be envisaged to use only two drive belts and one selection tongue interposed between these two belts, contrary to the example illustrated where three drive belts and two interposed selection tongues are provided.

The selection device further comprises downstream of the selection means, return means for driving upstream all the mail items except one issuing from the selection means. In effect, it may happen, albeit exceptionally, that the selection tongues select two and not one mail item. In that case, these return means preferably formed by as many conveying rollers 50, 52 as there exist selection tongues, make it possible to drive in the opposite direction the second mail item located uppermost and to allow to pass only the first lying lowermost and directly in contact with the drive belts 14, 16, 18. The conveyor rollers are mounted on a common shaft 56 driven in rotation, through a return belt 60 and drive gears, by a motorization shaft 62, itself driven in rotation by motor means 58. In addition, this motorization shaft constitutes a pivot pin about which the conveyor rollers are articulated in order to allow the insertion and drive of a mail item of considerable thickness (16 mm maximum for an initial separation plate of 20 mm).

The separation device functions as follows: The mail items stacked on the receiving plate of the feed zone are driven by the conveying rollers from this zone towards the selection device which will extract them one by one to direct them towards a following module of the feeder then towards the franking machine proper. At the level of the selection device, the stack of mail items on the receiving plate, to be handled, is firstly limited in height by the separation plate 10 then the mail items introduced are pressed against the drive belts 14, 16, 18 by the presser plate 20 which will pass from an inclined position to a horizontal position under the action of the articulated mechanism 22. Under the effect of the drive, the selected mail items are directed downstream towards the selection tongues against which they abut except for one of them which will be selected by this tongue, i.e. which will pass therebeneath, to be driven further downstream (cf. FIG. 2A). If, by chance, the selection tongues select two mail items instead of one, the rear conveying rollers will stop the advance of the double which, however, will be driven again when the selected item will have been evacuated (cf. FIG. 2B).

Figure 4:
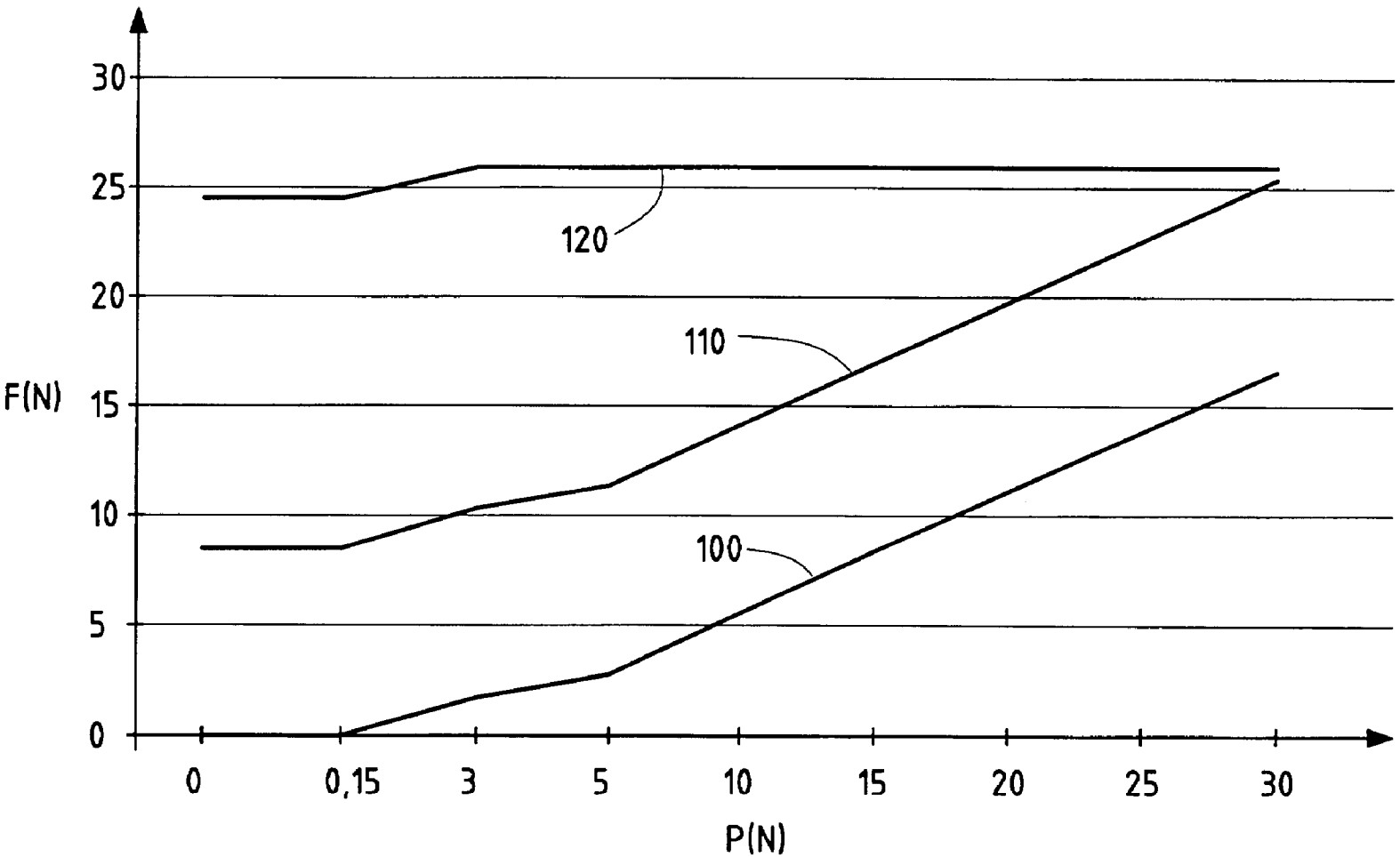
FIG. 4 schematically shows three curves of development of the efforts F as a function of the weight P of the mail items in the selection device according to the invention.

It will be noted that the individual mobility of the tongues makes it possible to take into account the differences in thickness that may exist in the same mail item, due in particular to the types of documents contained in these items. In addition, the independence of the tongues with respect to the presser plate allows a better apprehension of the drive efforts exerted by each of these elements. FIG. 4 illustrates this phenomenon perfectly, with, respectively at references 100, 110, 120, the efforts exerted as a function of the weight of the stack of mail items by respectively the first (34) and second (38, 40) elastic means of the presser plate and a selection tongue 26.

With the architecture of the present invention, the role of the weight of the stack of mail items on the function of selection of these items and therefore also on the outlet of the feeder is reduced. Moreover, in the case of passage of one sole item, the presser plate takes up the loss of effort in the receiving plate and allows a better drive of this item.

What is claimed is:

1. A selection device for separating one by one, or singulating, the items of a stack of mail items, comprising:

a support surface;

conveying means for driving these mail items over the support surface;

a mobile presser plate cooperating with the conveying means in order to drive downstream a part of the mail items issuing from the stack of mail items to be separated and corresponding to a predetermined maximum thickness of mail items, said mobile presser plate being pivotable between a first position and a second position angularly spaced from said first position; and independent, individually mobile selection means for selecting a mail item from the mail items driven by the conveying means.

2. The selection device of claim 1, wherein said presser plate is pivotable about a hinge pin of an articulated mechanism which is pivotable about a pivot pin so as to remain constantly parallel to said support surface whatever the number of mail items conveyed.

3. The selection device of claim 2, wherein the pivoting of said presser plate about said hinge pin is exerted against a first elastic member of which one end is fixed to said presser plate and the other end is fixed to said articulated mechanism.

4. The selection device of claim 3, wherein said presser plate comprises a stop for limiting its pivoting with the articulated mechanism.

5. The selection device of claim 3, wherein the pivoting of said articulated mechanism about said pivot pin is exerted against a second elastic member of which one end is fixed to said articulated mechanism and the other end is fixed to a fixed part of the device.

6. The selection device of claim 1, wherein said conveying means comprise parallel drive belts controlled by a common motor and extending through said support surface.

7. The selection device of claim 6, wherein said selection means comprise tongues interposed between the drive belts and acting against an elastic member of which one end is fixed on said tongue and the other end is fixed to said fixed part of the device.

8. The selection device of claim 1, wherein it further comprises, downstream of said selection means, articulated return means for driving upstream all the mail items except one issuing from said selection means.

9. Mail item feed device intended to be mounted upstream of a franking machine and comprising a device for receiving and conveying downstream a stack of mail items and a device for selecting one only of these mail items according to claim 1.

10. The selection device of claim 1, wherein the conveying means and the presser plate are disposed on a side of the mail items opposite the support surface.

11. The selection device of claim 1, wherein the presser plate and the selection means are disposed on the side of the mail items opposite the support surface.

* * * * *